US011982273B2

(12) United States Patent
Suzuki et al.

(10) Patent No.: US 11,982,273 B2
(45) Date of Patent: May 14, 2024

(54) VANE PUMP WITH A NOTCH PROVIDED AT A SUCTION PORT

(71) Applicant: KYB Corporation, Tokyo (JP)

(72) Inventors: Kazunari Suzuki, Kanagawa (JP); Shinji Yakabe, Tokyo (JP); Yusuke Kurita, Aichi (JP); Shota Shindou, Aichi (JP)

(73) Assignee: KYB CORPORATION, Tokyo (JP)

( * ) Notice: Subject to any disclaimer, the term of this patent is extended or adjusted under 35 U.S.C. 154(b) by 0 days.

(21) Appl. No.: 17/904,151

(22) PCT Filed: Apr. 19, 2021

(86) PCT No.: PCT/JP2021/015817
§ 371 (c)(1),
(2) Date: Aug. 12, 2022

(87) PCT Pub. No.: WO2021/241067
PCT Pub. Date: Dec. 2, 2021

(65) Prior Publication Data

US 2023/0060242 A1 Mar. 2, 2023

(30) Foreign Application Priority Data

May 27, 2020 (JP) ..... 2020-092179

(51) Int. Cl.
*F04C 2/344* (2006.01)
*F04C 15/06* (2006.01)

(52) U.S. Cl.
CPC ..... *F04C 2/3446* (2013.01); *F04C 15/06* (2013.01); *F04C 2250/10* (2013.01); *F04C 2250/101* (2013.01); *F04C 2250/102* (2013.01); *F04C 2250/20* (2013.01)

(58) Field of Classification Search
CPC .... F04C 2/3446; F04C 15/06; F04C 2250/10; F04C 2250/101; F04C 2250/102; F04C 2250/20; F01C 21/108
See application file for complete search history.

(56) References Cited

U.S. PATENT DOCUMENTS

| | | | | |
|---|---|---|---|---|
| 6,120,256 | A * | 9/2000 | Miyazawa | F04C 15/0049 417/220 |
| 9,828,991 | B2 * | 11/2017 | Muramatsu | F04C 2/344 |
| 9,897,086 | B2 * | 2/2018 | Fujita | F04C 2/3446 |
| 2011/0165010 | A1 * | 7/2011 | Iijima | F01C 21/108 418/269 |

FOREIGN PATENT DOCUMENTS

| | | | |
|---|---|---|---|
| JP | H11303773 | A | 11/1999 |
| JP | 2013-194697 | A | 9/2013 |
| JP | 2016017450 | A * | 2/2016 |

* cited by examiner

*Primary Examiner* — Mary Davis
(74) *Attorney, Agent, or Firm* — Rabin & Berdo, P.C.

(57) ABSTRACT

A vane pump includes: a suction port configured to guide working oil to a pump chambers; a discharge port configured to guide the working oil discharged from the pump chambers; and a notch formed from an opening edge portion of the suction port towards a reversing direction of a rotation direction of a rotor, wherein the pump chambers each communicates with the suction port through the notch during a course of the transition from the state, in which the pump chamber is in communication with the discharge port, to the state, in which the communication with the discharge port is shut off, as the rotor is rotated.

4 Claims, 9 Drawing Sheets

VANE PUMP WITH A NOTCH PROVIDED AT A SUCTION PORT

TECHNICAL FIELD

The present invention relates to a vane pump.

BACKGROUND ART

JP2013-194697A discloses a vane pump including: a rotor that is rotationally driven; a plurality of slits that are formed in a radiating pattern in the rotor; a plurality of vanes that are respectively and freely slidably received in the slits; an inner circumference cam face along which tip end portions of the vanes slide; pump chambers that are defined by the inner circumference cam face and the adjacent vanes; suction ports that guide working fluid to be sucked into the pump chambers; and discharge ports that guide the working fluid discharged from the pump chambers.

This vane pump has suction regions in which volumes of the pump chambers are increased along with the rotation of the rotor; discharge regions in which the volumes of the pump chambers are decreased; and transition regions between the suction regions and the discharge regions.

SUMMARY OF INVENTION

In the vane pump as disclosed in JP2013-194697A, when the pump chamber communicates with neither of the suction ports and the discharge ports and the pump chamber is enclosed, a sudden increase in the pressure in the pump chamber may be caused, which in turn causes vibration or noise. Thus, in such a vane pump, the pump chamber may be caused to communicate with both of the suction port and the discharge port in the transition region to prevent the pump chamber from being enclosed.

However, if the pump chamber is caused to communicate with both of the suction port and the discharge port, there is a risk in that the working fluid in the discharge port, where the pressure is relatively high, is guided to the suction port through the pump chamber. If such a flow of the working fluid from the discharge port to the suction port is caused, flow amount of the working fluid discharged from the vane pump is decreased, and therefore, a volumetric efficiency of the pump is also decreased.

Therefore, in order to ensure the volumetric efficiency of the pump while preventing the enclosure of the pump chambers, a design accuracy and a processing accuracy for the vane pump are required at a high standard, and it is difficult to achieve it.

An object of the present invention is to provide a vane pump capable of improving a volumetric efficiency of a pump while preventing enclosure of the pump chambers.

According to an aspect of the present invention, a vane pump is provided with: a rotor linked to a driving shaft; a plurality of vanes provided so as to be freely reciprocatable in radial direction with respect to the rotor; a cam ring having an inner circumferential surface on which tip ends of the vanes slide as the rotor is rotated; pump chambers defined by the rotor, the cam ring, and a pair of the adjacent vanes; a suction port configured to guide working fluid to the pump chambers; a discharge port configured to guide the working fluid discharged from the pump chambers; and a notch formed from an opening edge portion of the suction port towards a reversing direction of a rotation direction of the rotor. Each of the pump chambers is configured to communicate with the suction port through the notch during a course of a transition from a state, in which the pump chamber is in communication with the discharge port, to a state, in which the communication with the discharge port is shut off, as the rotor is rotated.

DESCRIPTION OF EMBODIMENTS

In the following, a vane pump 100 according to an embodiment of the present invention will be described with reference to the drawings.

The vane pump 100 is used as a fluid pressure source for a fluid pressure apparatus, such as, for example, a power steering apparatus, a continuously variable transmission, and so forth that is mounted on vehicles and industrial machineries. In this embodiment, the fixed displacement vane pump 100 using working oil as working fluid will be described. The vane pump 100 may also be a variable displacement vane pump.

Figure 2:
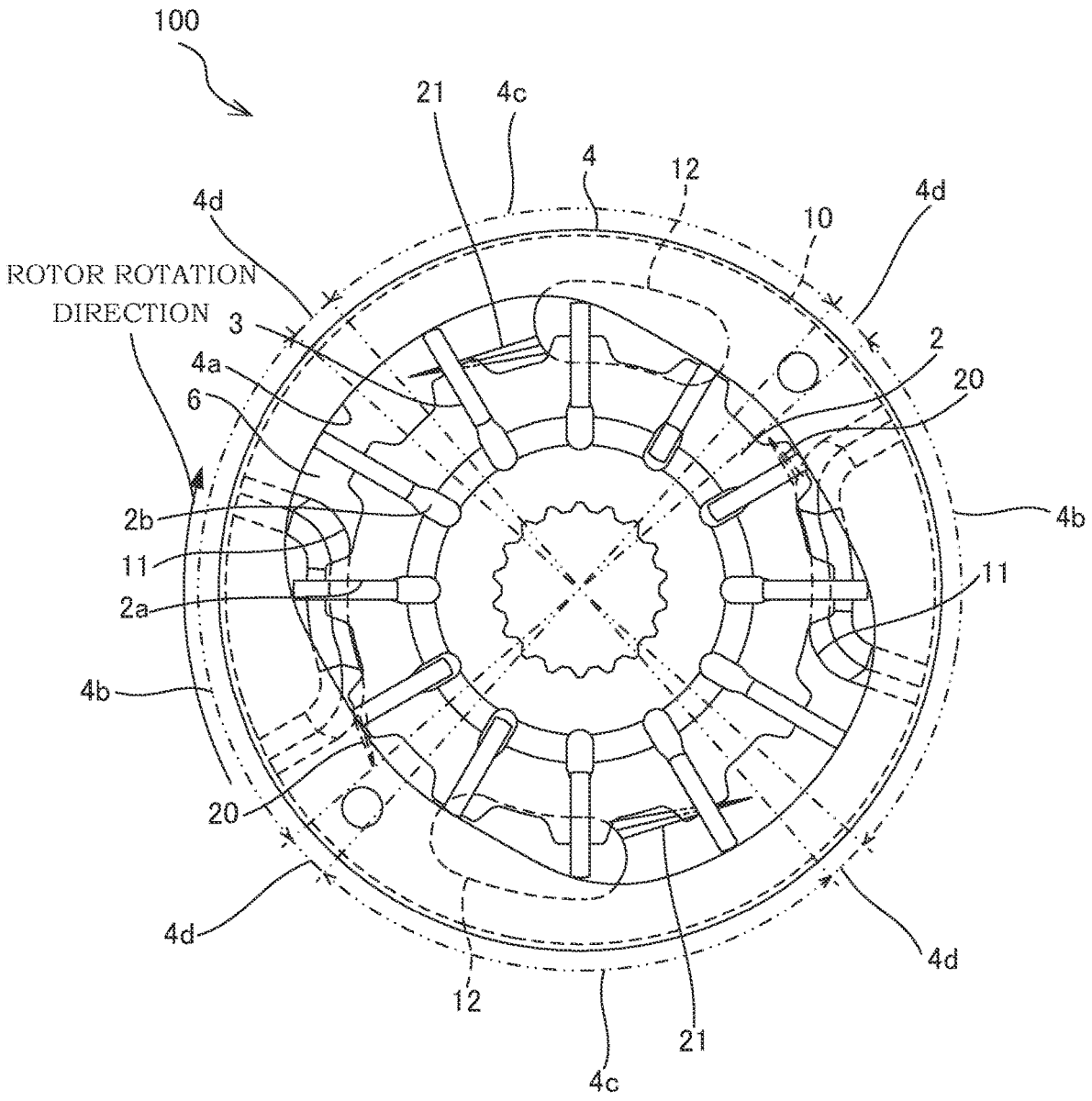
FIG. 2 is a side view of a rotor, a cam ring, and a side plate in the vane pump according to the embodiment of the present invention.

In the vane pump 100, a motive force from a driving source such as an engine, etc. (not shown) is transmitted to an end portion of a driving shaft 1, and a rotor 2 linked to the driving shaft 1 is rotated. In FIG. 2, the rotor 2 is rotated clockwise. The driving source of the vane pump 100 may be an electric motor instead of the engine.

Figure 1:
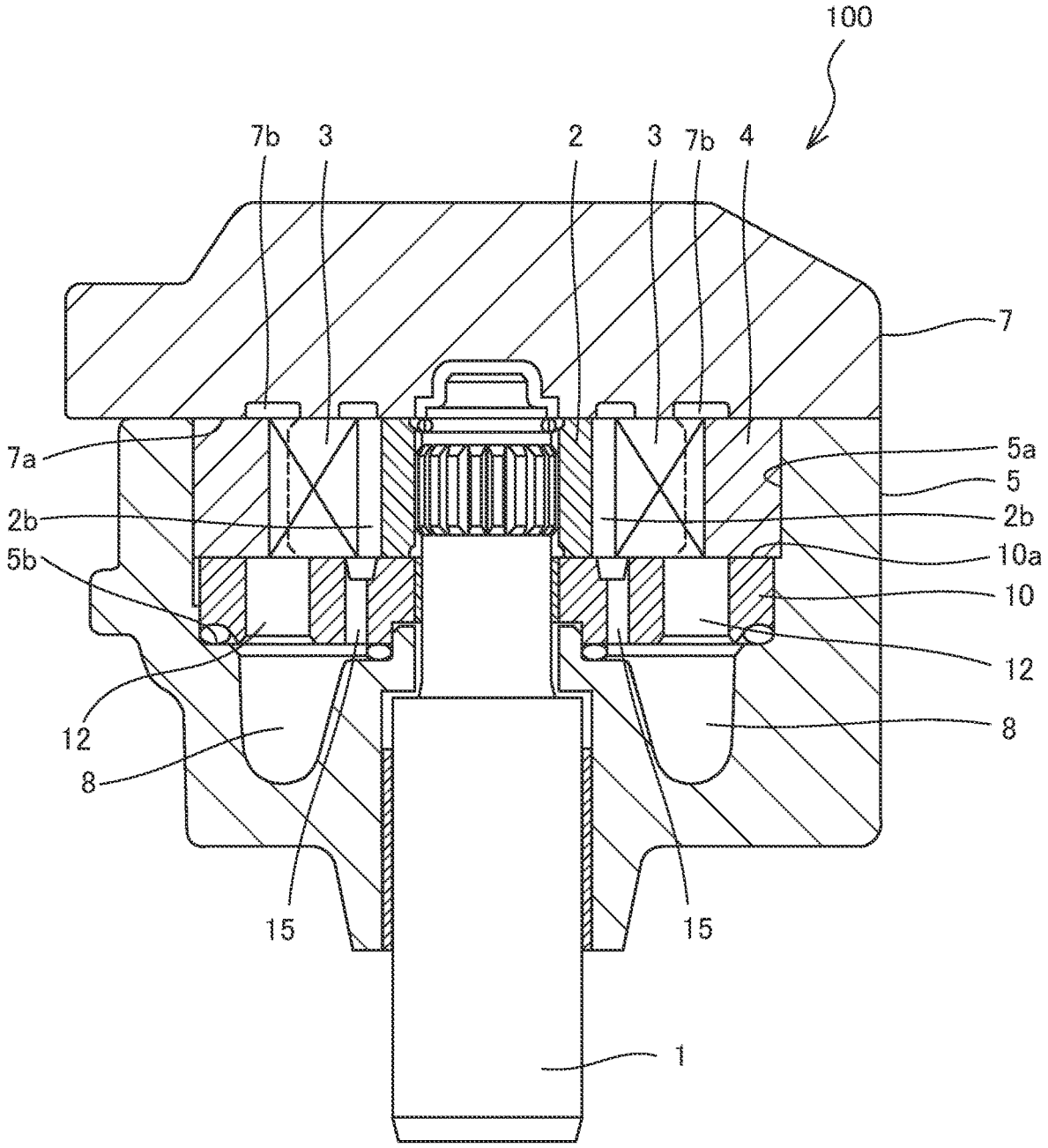
FIG. 1 is a sectional view of a vane pump according to an embodiment of the present invention.

As shown in FIGS. 1 and 2, the vane pump 100 is provided with: a plurality of vanes 3 having a plate shape that are provided so as to be freely reciprocatable in the radial direction relative to the rotor 2; a cam ring 4 that accommodates the rotor 2 and in which tip end portions of the vanes 3 slide along a cam face 4*a*, which is an inner circumferential surface, along with the rotation of the rotor 2; and a housing 5 that accommodates the rotor 2 and the cam ring 4.

A plurality of pump chambers 6 are defined by the rotor 2, the cam ring 4, and a pair of adjacent vanes 3 (see FIG. 2).

The rotor 2 is an annular member and is linked to the tip end portion of the driving shaft 1 with a spline connection. In the rotor 2, slits 2*a* having openings at an outer circumferential surface are formed in a radiating pattern, and the vanes 3 are respectively inserted into the slits 2*a* in a freely slidable manner. In bottom portions of the slits 2*a*, back pressure chambers 2*b* are respectively defined by bottom surfaces of the vanes 3.

The cam ring 4 is an annular member having the substantially oval shaped cam face 4*a* with a minor axis and a major axis. The cam ring 4 has two suction regions 4*b* in which the volumes of the pump chambers 6 are increased along with the rotation of the rotor 2, two discharge regions 4*c* in which the volumes of the pump chambers 6 are decreased along with the rotation of the rotor 2, and four transition regions 4*d* that are respectively formed between the suction regions 4*b* and the discharge regions 4*c*. In other words, as the rotor 2 completes a full rotation, the vanes 3 reciprocate twice, and the pump chambers 6 undergo the expansion and contraction twice repeatedly. The suction regions 4*b*, the discharge regions 4*c*, and the transition regions 4*d* are defined by the shape of the cam face 4*a*.

As shown in FIG. 1, a first side plate 10 is arranged so as to come into contact with first side surfaces of the rotor 2 and the cam ring 4.

The rotor 2, the cam ring 4, and the first side plate 10 are accommodated in a pump accommodating portion 5*a* that is formed in the housing 5 so as to have a recessed shape. The pump accommodating portion 5*a* is closed by a pump cover 7. The pump cover 7 is arranged so as to come into contact with second side surfaces of the rotor 2 and the cam ring 4. The first side plate 10 and the pump cover 7 are arranged in a state in which both side surfaces of the rotor 2 and the cam ring 4 are sandwiched, and thereby, the pump chambers 6 are sealed. The first side plate 10 and the pump cover 7 function as the side members that are arranged so as to come into contact with the first side surfaces of the rotor 2 and the cam ring 4.

In a bottom surface 5*b* of the pump accommodating portion 5*a*, a high-pressure chamber 8 into which the working oil that has been discharged from the pump chambers 6 is guided is formed so as to have an annular shape. The high-pressure chamber 8 is defined by the first side plate 10 arranged on the bottom surface 5*b*. The high-pressure chamber 8 communicates with a discharge passage (not shown) that is formed so as to open at an outer surface of the housing 5.

An end surface 7*a* of the pump cover 7 on which the rotor 2 slides is formed with two arc-shaped suction ports (not shown) that are opened correspondingly to two suction regions 4*b* of the cam ring 4 and guide the working oil to the pump chambers 6. In addition, the end surface 7*a* of the pump cover 7 is formed with two arc-shaped discharge ports 7*b* having a groove shape that open correspondingly to the discharge regions 4*c* of the cam ring 4. Furthermore, the pump cover 7 is formed with a suction passage (not shown) that guides the working oil in a tank to the pump chambers 6 through the suction ports.

Figure 3:
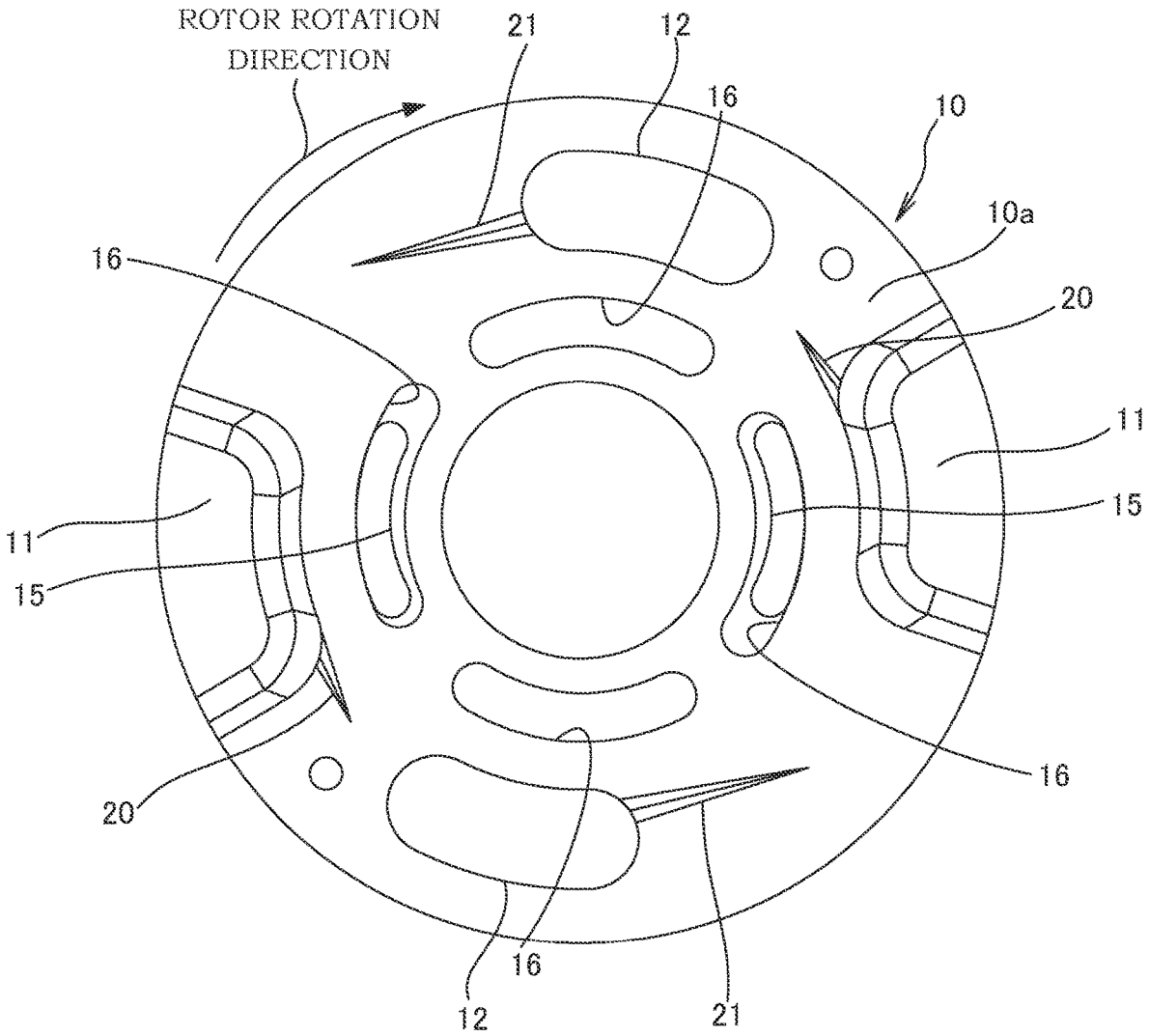
FIG. 3 is a side view of a side plate of the vane pump according to the embodiment of the present invention.

FIG. 3 is a plan view of an end surface 10*a* of the first side plate 10 on which the rotor 2 slides. As shown in FIG. 3, the first side plate 10 is a disc-shaped member having two suction ports 11 and two discharge ports 12.

The suction ports 11 are formed in the end surface 10*a* of the first side plate 10 to have a groove shape so as to open correspondingly to the two suction regions 4*b* in the cam ring 4 to guide the working oil to the pump chambers 6. The suction ports 11 are communicated with the suction ports of the pump cover 7 through passages (not shown) formed in an inner circumferential surface of the pump accommodating portion 5*a*. Therefore, the working oil from the suction passage is guided to the pump chambers 6 through the suction ports of the pump cover 7 and the suction ports 11 of the first side plate 10.

The discharge ports 12 are formed to have an arc shape and to penetrate through the first side plate 10. The discharge ports 12 are formed correspondingly to the discharge regions 4*c* of the cam ring 4 and discharge the working oil in the pump chambers 6 to the high-pressure chamber 8.

In addition, notches 20 that respectively communicate with end portions of the suction ports 11 and notches 21 that respectively communicate with end portions of the discharge ports 12 are formed in the end surface 10*a* of the first side plate 10 so as to respectively have the groove shape.

The notch 20 is formed for each of the two suction ports 11. As shown in FIG. 3, the notches 20 are each formed so as to extend from an opening edge portion (the end portion) of the suction port 11 at the rear side in the rotation direction towards the reversing direction of the rotation direction.

The notches 20 are each formed to have the groove shape such that the opening area is gradually increased towards the rotation direction of the rotor 2. The opening area of the notch 20 is the cross-sectional area of the notch 20 in the plane extending along the radial direction of the rotor 2. The cross-sectional shape of the notch 20 in the plane extending along the radial direction of the rotor 2 is formed to have a V-shape. The groove-depth of the notches 20 is increased towards the rotation direction of the rotor 2. In addition, the notches 20 are each connected to a radially-inside inner wall surface of the suction port 11.

The notch 21 is formed for each of the two discharge ports 12. Similarly to the notches 20 of the suction ports 11, the notches 21 are each formed to have the groove shape such that the opening area is gradually increased towards the rotation direction of the rotor 2.

The first side plate 10 is formed with two back pressure passages 15 that penetrate the first side plate 10 and that guides the working oil from the high-pressure chamber 8 to the back pressure chambers 2*b* of the rotor 2 (see FIG. 2). In addition, the end surface 10*a* of the first side plate 10 is formed with four arc-shaped grooves 16 that communicate with the back pressure chambers 2*b*.

Relative rotation between the cam ring 4, the first side plate 10, and the pump cover 7 is restricted by two positioning pins (not shown). With such a configuration, alignment of the suction ports 11 and the discharge ports 12 of the first side plate 10 and alignment of the suction ports and the discharge ports 7*b* of the pump cover 7 with respect to the suction regions 4*b* and the discharge regions 4*c* in the cam ring 4 are respectively performed. In addition, the suction ports 11 of the first side plate 10 and the suction ports of the pump cover 7 are formed at corresponding positions with respect to each other. The discharge ports 12 of the first side plate 10 and the discharge ports 7*b* of the pump cover 7 are formed at corresponding positions with respect to each other.

As the engine is driven and the driving shaft 1 is rotated, the rotor 2 linked to the driving shaft 1 is then rotated. As a result, each of the pump chambers 6 in the cam ring 4 sucks the working oil in the suction regions 4*b* through the suction ports of the pump cover 7 and the suction ports 11 of the first side plate 10 and discharges the working oil to the high-pressure chamber 8 in the discharge regions 4*c* through the discharge ports 7*b* of the pump cover 7 and the discharge ports 12 of the first side plate 10. The working oil in the high-pressure chamber 8 is supplied to the fluid pressure apparatus through the discharge passage. As described above, each of the pump chambers 6 in the cam ring 4 supplies/discharges the working oil by the expansion/contraction caused along with the rotation of the rotor 2.

In the following, action of the vane pump 100 will be described with reference to FIGS. 4 to 7.

FIGS. 4 to 7 are enlarged views showing a vicinity of the pump chamber 6 in the transition region 4*d* during a transition from the discharge region 4*c* to the suction region 4*b*. An arrow shown in each of FIGS. 4 to 7 shows the rotation direction of the rotor 2.

Figure 4:
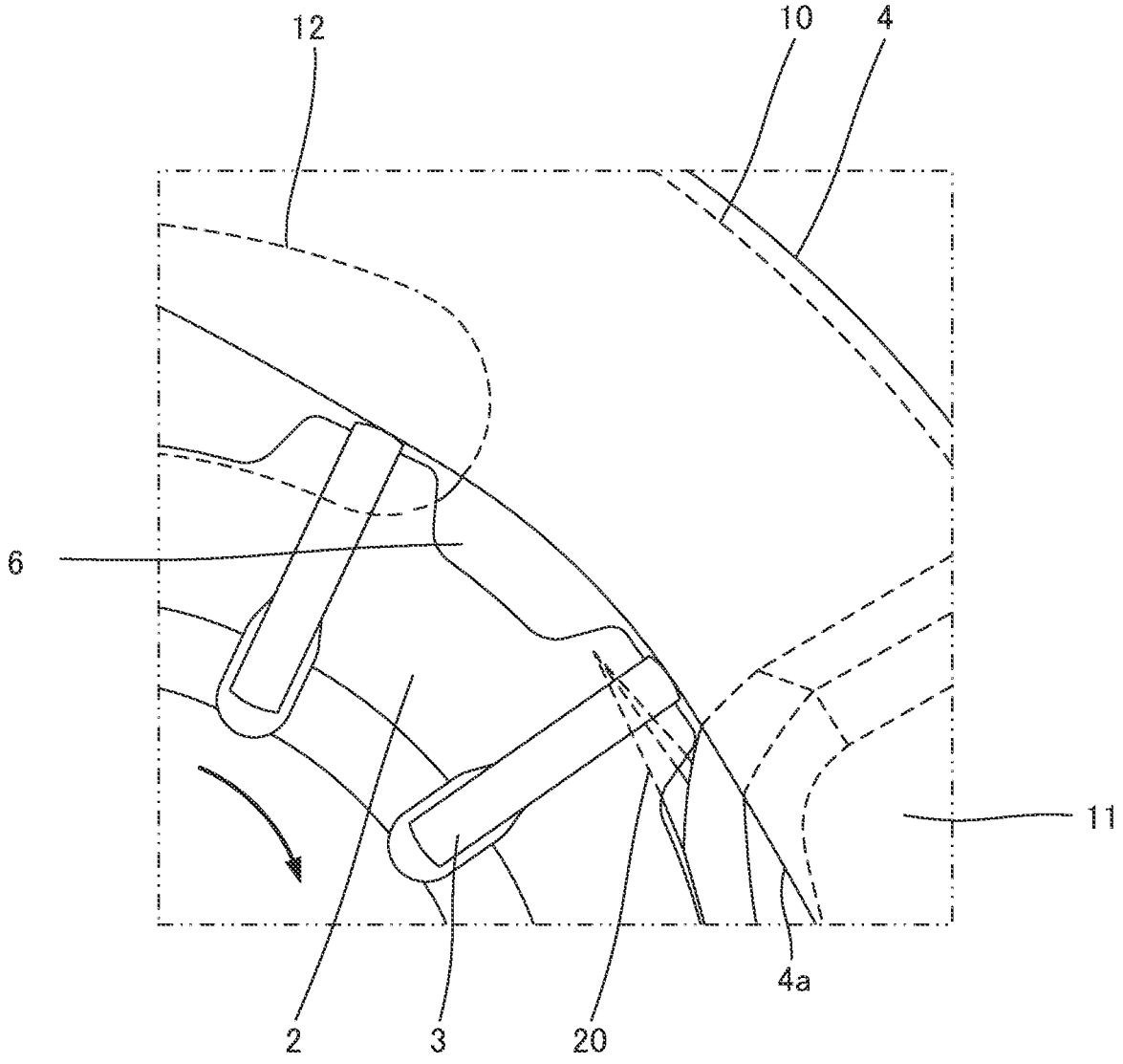
FIG. 4 is a first enlarged view showing a vicinity of a pump chamber in a transition region in the vane pump according to the embodiment of the present invention.

In the state shown in FIG. 4, while the pump chamber 6 communicates with the discharge port 12, the pump chamber 6 does not communicate with the suction port 11.

Figure 5:
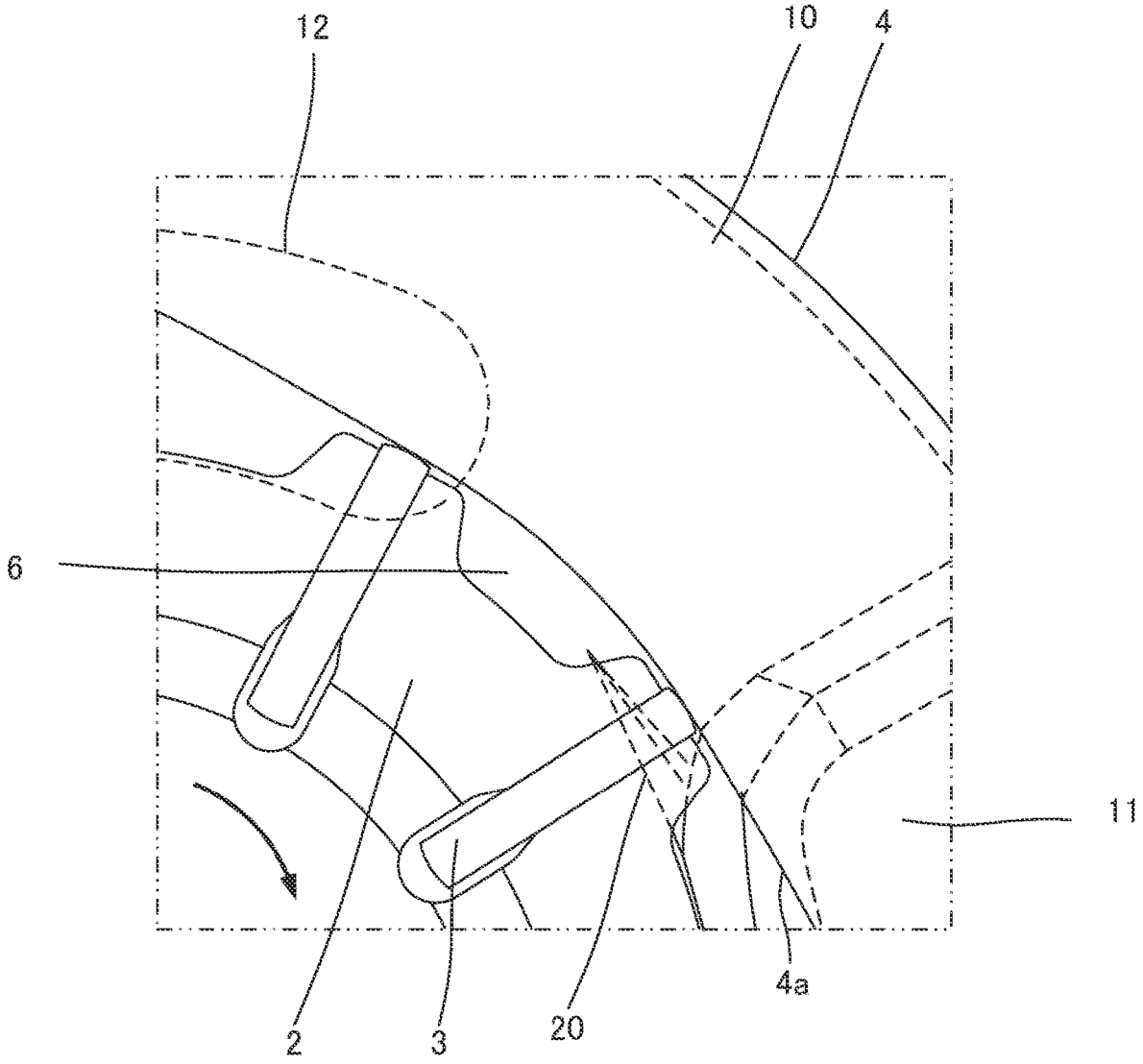
FIG. 5 is a second enlarged view showing the vicinity of the pump chamber in the transition region in the vane pump according to the embodiment of the present invention.

As the rotor 2 is further rotated from the state shown in FIG. 4, the pump chamber 6 is now in a state in which the pump chamber 6 communicates with the discharge port 12 and does not communicate with the suction port 11 directly, but communicates with the suction port 11 only through the notch 20 (see FIG. 5). As described above, in the transition region 4*d*, the pump chamber 6 is configured such that the state in which the pump chamber 6 communicates with both of the discharge port 12 and the suction port 11 is established, and the pump chamber 6 is configured such that the state in which the pump chamber 6 communicates with neither of the discharge port 12 and the suction port 11 is not to be established. With such a configuration, the working oil is prevented from being trapped in the pump chamber 6 in the transition region 4*d*. Although a detailed description is omitted, also at the transition region 4*d* where the pump chamber 6 moves from the suction region 4*b* to the discharge region 4*c*, the suction port 11 is communicated with the discharge port 12 by the notch 21 of the discharge port 12, and the enclosure of the pump chamber 6 is prevented.

Figure 6:
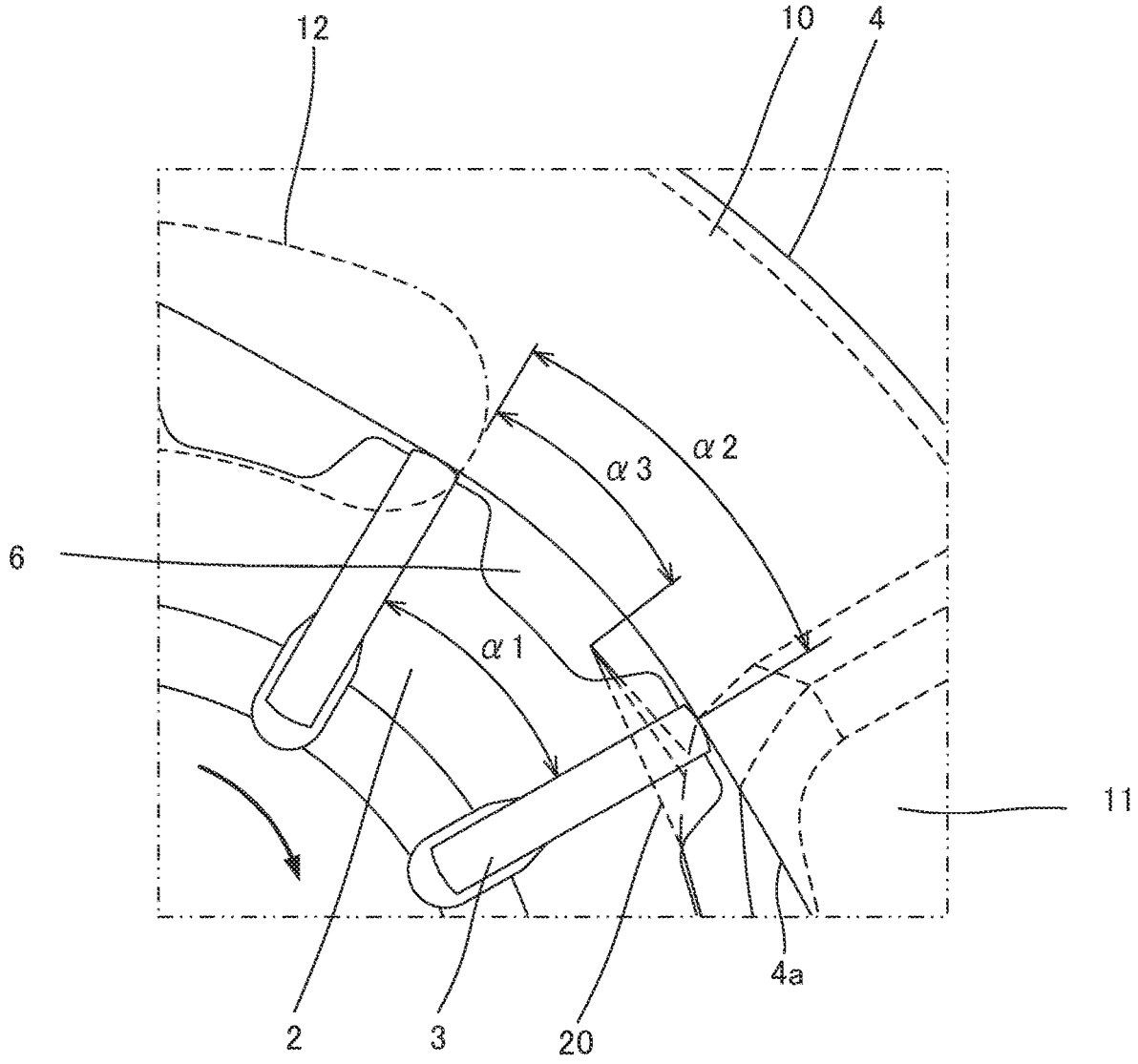
FIG. 6 is a third enlarged view showing the vicinity of the pump chamber in the transition region in the vane pump according to the embodiment of the present invention.

As the rotor 2 is further rotated from the state shown in FIG. 5, while the pump chamber 6 maintains the state in which the pump chamber 6 communicates with the suction port 11 only through the notch 20, the pump chamber 6 is shifted to a state in which the communication between the pump chamber 6 and the discharge port 12 is shut off (see FIG. 6). In other words, as the rotor 2 is rotated, during a course of the transition from the state in which the pump chamber 6 communicates with the discharge port 12 (the state shown in FIG. 5) to the state in which the communication between the pump chamber 6 and the discharge port 12 is shut off (the state shown in FIG. 6), the pump chamber 6 is maintained at the state in which the pump chamber 6 communicates with the suction port 11 only through the notch 20 and the pump chamber 6 does not communicates with the suction port 11 directly.

Figure 7:
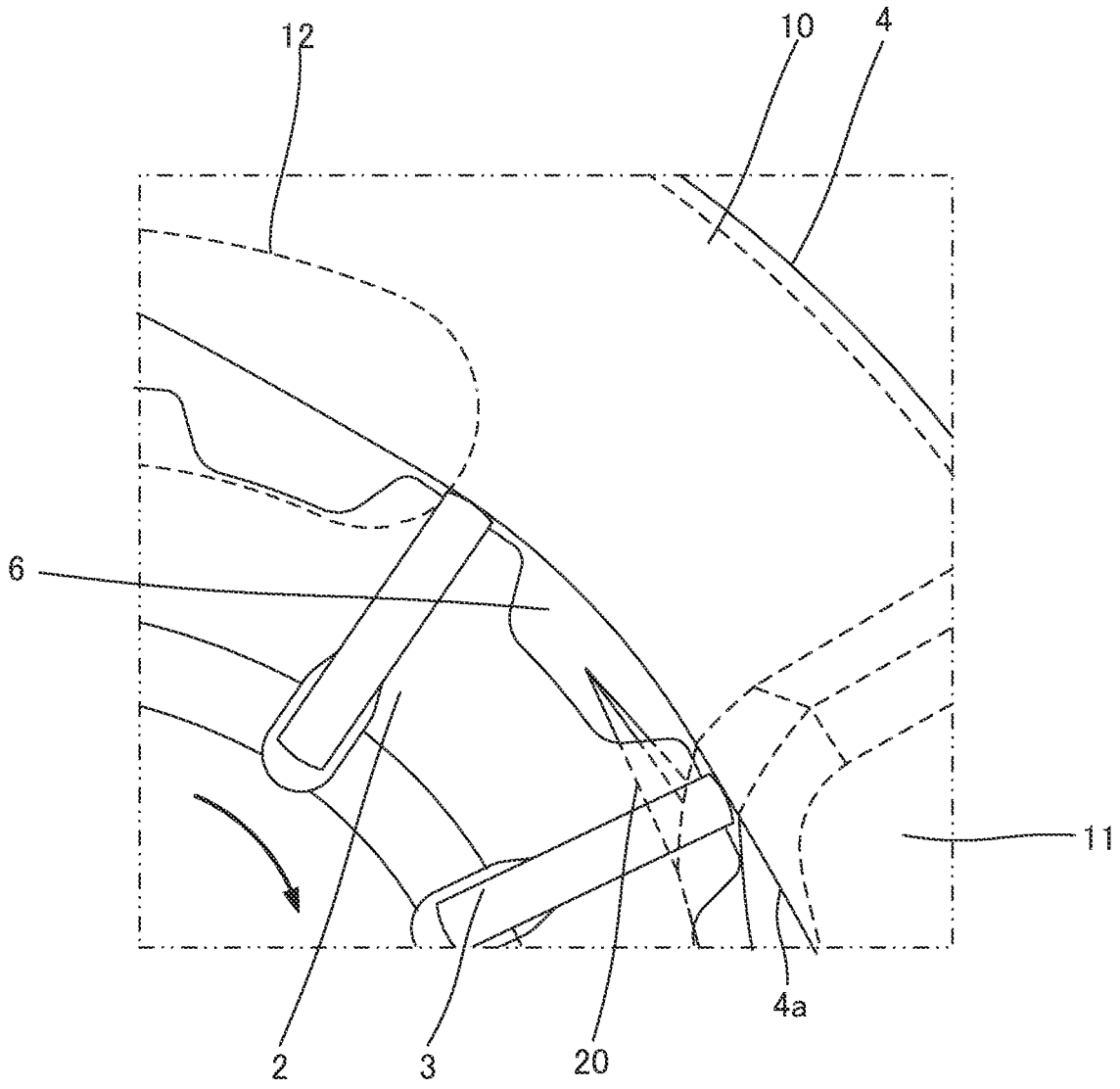
FIG. 7 is a fourth enlarged view showing the vicinity of the pump chamber in the transition region in the vane pump according to the embodiment of the present invention.

As the rotor 2 is further rotated from this state, the pump chamber 6 is shifted to a state in which the pump chamber 6 not only communicates with the suction port 11 through the notch 20, but also communicates with the suction port 11 directly (see FIG. 7). By the time at which the pump chamber 6 communicates with the suction port 11 directly, the communication between the pump chamber 6 and the discharge port 12 is shut off.

Although illustration is omitted, the notch 20 and the notch 21 are not formed for each of the suction ports and the discharge ports 7*b* of the pump cover 7. Thus, the suction port and the discharge port 7*b* of the pump cover 7 do not communicate with each other through the pump chamber 6.

As described above, in the state in which the pump chamber 6 communicates with the discharge port 12, the pump chamber 6 does not communicate with the suction port 11 directly, but communicates with the suction port 11 only through the notch 20. In other words, the discharge port 12 communicates with the suction port 11 only through the pump chamber 6 and the notch 20. Specifically, as shown in FIG. 6, the center angle (first center angle) $\alpha 1$ between the adjacent vanes 3 about the center of the rotor 2 (the cam ring 4) is set so as to be equal to or smaller than the center angle (second center angle) (an angle between the end portions opening at an inner circumference of the cam ring 4) $\alpha 2$ between the suction port 11 and the discharge port 12 ($\alpha 1 \leq \alpha 2$). The center angle (third center angle) $\alpha 3$ between the notch 20 and the discharge port 12 is set so as to be smaller than the center angle $\alpha 1$ between the vane 3 ($\alpha 3 < \alpha 1$). With such a configuration, the discharge port 12 is configured so as to communicate with the suction port 11 only through the notch 20.

Thus, even in the state in which the discharge port 12 and the suction port 11 communicate with each other, because a flow path resistance (pressure loss) is caused by the notch 20, the flow amount of the working oil from the discharge port 12 towards the suction port 11 is suppressed. In other words, it is possible to control the flow amount of the working oil from the discharge port 12 towards the suction port 11 by the notch 20. Thus, a discharge flow amount of the vane pump 100 at which the working oil is discharged from the discharge port 12 to the outside through a high-pressure passage can be ensured, and it is possible to improve the volumetric efficiency.

Figure 8:
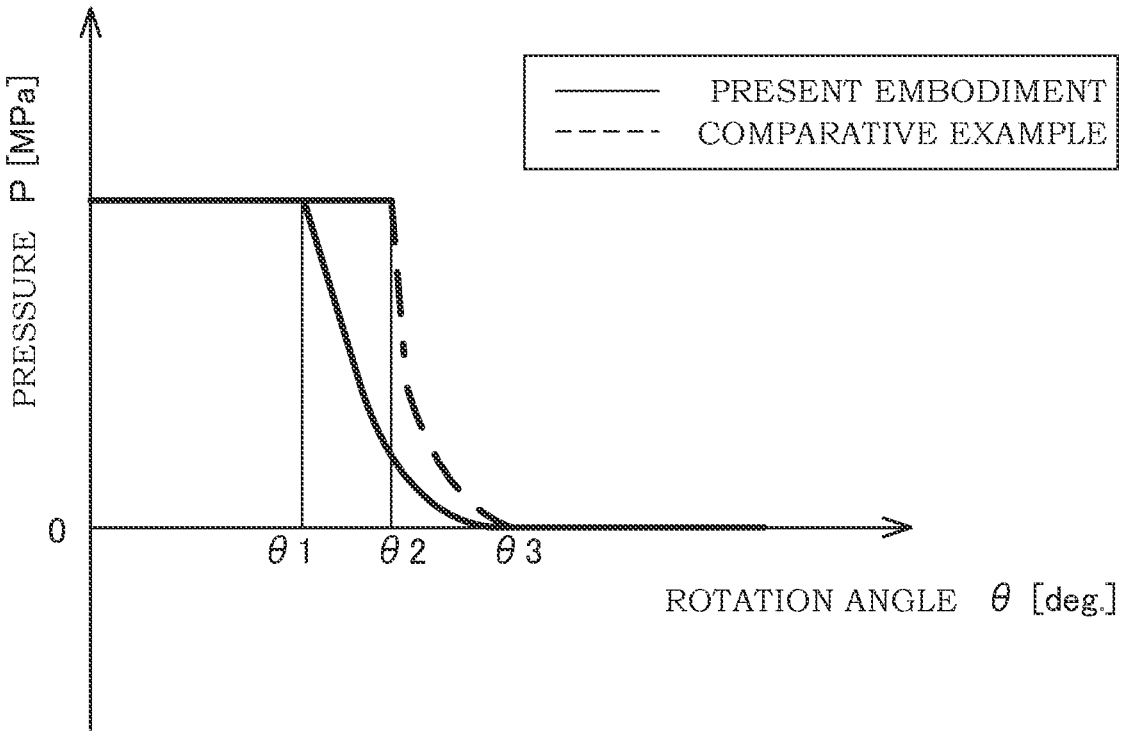
FIG. 8 is a graph schematically showing a pressure change of a pressure chamber in the vane pump according to the embodiment of the present invention.
Figure 9:
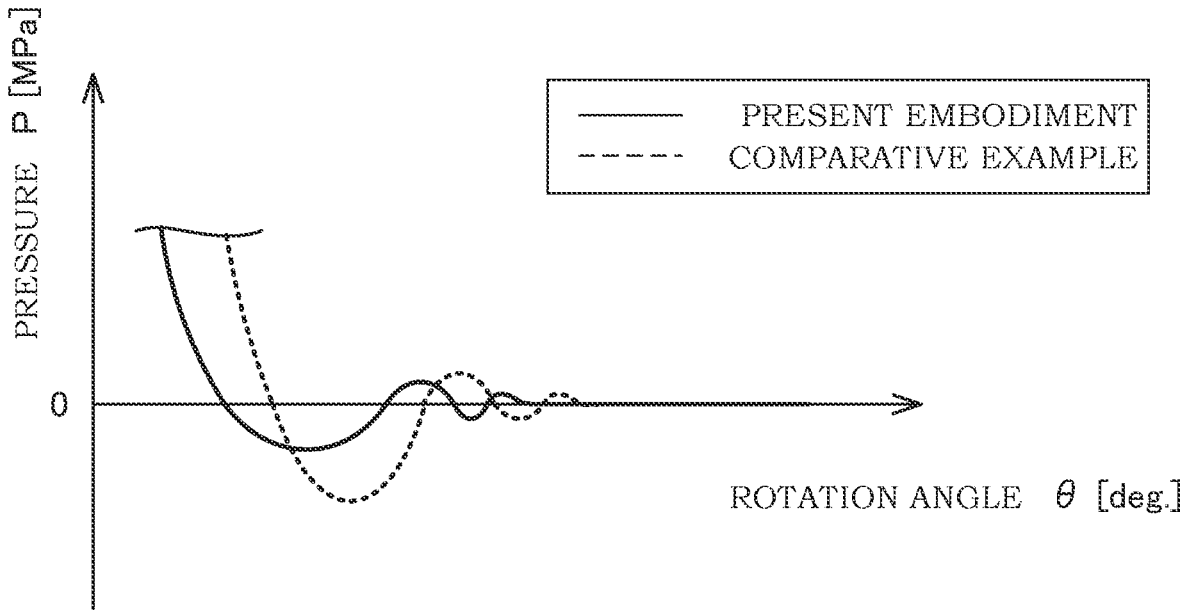
FIG. 9 is a graph showing, in a magnified view, a region where a rotation angle is close to θ3 in FIG. 8.

FIG. 8 is a graph schematically showing the pressure in the pump chamber 6 that passes the transition region 4*d* for the transition from the discharge region 4*c* to the suction region 4*b*. The vertical axis in the graph in FIG. 8 shows a pressure P [MPa] in the pump chamber 6, and the horizontal axis shows a rotation angle (angular position) $\theta$ [deg] of the pump chamber 6 during the rotation direction of the rotor 2. On the vertical axis, 0 MPa indicates a reference pressure (the atmospheric pressure in this embodiment). In the graph in FIG. 8, a solid line shows the pressure in the pump chamber 6 in the vane pump 100 in this embodiment. In the graph in FIG. 8, a broken line shows a comparative example in which the notch 20 is not formed, and the pump chamber 6 directly communicates with each of the discharge port 12 and the suction port 11 in the transition region 4*d* from the discharge region 4*c* to the suction region 4*b*. In addition, FIG. 9 is a graph showing, in a magnified view, a region around the rotation angle $\theta = \theta 3$ in the graph shown in FIG. 8.

As shown in FIG. 8, in the comparative example, as the pump chamber 6 in communication with the discharge port 12 communicates with the suction port 11 (the rotation angle $\theta = \theta 2$), the pressure in the pump chamber 6 is dropped rapidly. At this timing, a jet stream may be caused as the working oil in the pump chamber 6 under a relatively high pressure flows rapidly into the suction port 11 under a low pressure. Due to occurrence of such a jet stream, in the comparative example, as shown in FIG. 9, there is a risk in that the pressure in the pump chamber 6 drops below the reference pressure (overshooting). The rotation angle $\theta = \theta 3$ in FIG. 8 indicates a position at which the communication between the pump chamber 6 and the discharge port 12 is shut off.

In contrast, in this embodiment, the pump chamber 6 communicates with the suction port through the notch 20 before it comes to communicates directly with the suction port 11. Specifically, the pump chamber 6 communicates with the notch 20 at the rotation angle $\theta 1$ that is smaller than the rotation angle $\theta 2$ at which the pump chamber 6 communicates with the suction port 11 in the comparative example. With such a configuration, in this embodiment, because the jet stream is caused gradually through the notch 20 at the earlier stage than in the case of the comparative example, as shown in FIG. 8, a gradient of the pressure drop is more gentle than that for the comparative example, and the rapid formation of the jet stream from the pump chamber 6 to the suction port 11 is suppressed. In other words, it is possible to suppress a flow speed of the jet stream from the pump chamber 6 to the suction port 11. Thus, as shown in FIG. 9, such a pressure drop in the pump chamber 6 that causes the pressure to fall below the reference pressure is suppressed.

As described above, in this embodiment, by suppressing the rapid formation of the jet stream from the pump chamber 6 to the suction port 11, it is possible to suppress the pressure change in the pump chamber 6 in the transition region 4*d* for the transition from the discharge region 4*c* to the suction region 4*b*.

According to the embodiment mentioned above, the advantages described below are afforded.

In the vane pump 100, because the pump chamber 6 is in communication with the suction port 11 through the notch 20 at the time when the state in which the pump chamber 6 is in communication with the discharge port 12 is shifted to the state in which the pump chamber 6 is shut off from the discharge port 12, the enclosure of the pump chamber 6 is prevented. In addition, because the pump chamber 6 communicates with the suction port 11 through the notch 20, the resistance is applied by the notch 20 to the flow of the working oil flowing from the discharge port 12 towards the suction port 11 through the pump chamber 6. Thus, the flow amount of the working oil flowing from the discharge port 12 towards the suction port 11 is suppressed, and it is possible to improve the volumetric efficiency while preventing the enclosure of the pump chamber 6. Furthermore, it is possible to suppress the rapid formation of the jet stream from the pump chamber 6 to the suction port 11.

Next, modifications of this embodiment will be described. The following modifications also fall within the scope of the present invention, and it is also possible to combine the configurations shown in the modifications with the configurations described in the above-described embodiment or to combine the configurations described in the following different modifications.

The shapes of the notches 20 are not limited to the configuration described in the above-mentioned embodiment, and they are designed appropriately in accordance with a specification, etc. of the vane pump 100 so that desired effects are respectively achieved for the prevention of enclosure of the pump chambers 6 and the improvement of the volumetric efficiency. For example, a part of or all of the notches 20 may be shaped so as to have a shape having the constant opening area that is not changed towards the rotation direction of the rotor 2. For example, the notch 20 may be formed such that a part thereof has a constant groove-depth along the rotation direction of the rotor 2. In addition, the cross-sectional shape of the notch 20 in a plane along the radial direction of the rotor 2 may be other shape than the V shape, such as a rectangular shape, an arc shape, or the like. In addition, the notch 20 may be connected to the center portion of the width of the suction port 11 in the radial direction, or it may be connected to an inner wall surface of the suction port 11 on the radially outer side. Furthermore, a plurality of notches 20 (two or more notches 20) may be formed so as to be connected to a single suction port 11.

Furthermore, in the above-mentioned embodiment, although the notch 20 is not formed for the discharge port 12, the notch 20 connected to the discharge port 12 may be formed.

In addition, in addition to the first side plate 10 serving as the side member that is arranged so as to be in contact with the first side surfaces of the rotor 2 and the cam ring 4, a second side plate serving as the side member may also be arranged so as to be in contact with the second side surfaces of the rotor 2 and the cam ring 4. In other words, the pump chambers 6 may be defined by sandwiching the rotor 2 and the cam ring 4 with two side plates (the side members) from the both sides.

In addition, in the above-mentioned embodiment, a description has been given of the notches 20 each of which is formed in the end surface 10*a* of the first side plate 10 and in communication with the end portion of the suction port 11. In contrast, similarly to those described in the above-mentioned embodiment, it may be possible to provide the notch 20 on the suction port that is formed in the pump cover 7 or the second side plate provided on the second side surfaces of the rotor 2 and the cam ring 4. In this case, the notch 20 may be provided on both of the first side surface side (the first side plate 10) and the second side surface side (the pump cover 7 or the second side plate) of the rotor 2, or the notch 20 may be provided on either one of them. In either case, the operational advantages similar to those of the above-mentioned embodiment are afforded.

The phrase "the discharge port 12 communicates with the suction port 11 only through the notch 20" should not be construed in a strict sense. There is no intention to exclude, from the technical scope of the present invention, a configuration in which the discharge port 12 is caused to communicate with the suction port 11 through the pump chamber 6, which is in direct communication with the suction port 11, as a consequence of processing errors, etc.

The configurations, operations, and effects of the embodiments of the present invention will be collectively described below.

The vane pump 100 includes: the rotor 2 linked to the driving shaft 1; the plurality of vanes 3 provided so as to be freely reciprocatable in the radial direction with respect to the rotor 2; the cam ring 4 having the cam face 4*a* on which tip ends of the vanes 3 slide as the rotor 2 is rotated; the pump chambers 6 defined by the rotor 2, the cam ring 4, and the pair of adjacent vanes 3; the suction port 11 configured to guide the working oil to the pump chambers 6; the discharge port 12 configured to guide the working oil discharged from the pump chambers 6; and the notch 20 formed from the opening edge portion of the suction port 11 towards the reversing direction of the rotation direction of the rotor 2, wherein the pump chambers 6 each communicates with the suction port 11 through the notch 20 during a course of the transition from the state, in which the pump chamber 6 is in communication with the discharge port 12, to the state, in which the communication with the discharge port 12 is shut off, as the rotor 2 is rotated.

In addition, in the vane pump 100, the center angle $\alpha 1$ between the adjacent vanes 3 about the center of the rotor 2 is set so as to be equal to or smaller than the center angle $\alpha 2$ between the suction port 11 and the discharge port 12, and the center angle $\alpha 3$ between the notch 20 and the discharge port 12 is set so as to be smaller than the center angle $\alpha 1$ between the adjacent vanes 3.

With such a configuration, because the pump chamber 6 communicates with the suction port 11 through the notch 20 at the time when the state in which the pump chamber 6 is in communication with the discharge port 12 is shifted to the state in which the pump chamber 6 is shut off from the discharge port 12, the enclosure of the pump chamber 6 is prevented. In addition, because the pump chamber 6 communicates with the suction port 11 through the notch 20, the resistance is applied by the notch 20 to the flow of the working oil flowing from the discharge port 12 towards the suction port 11 through the pump chamber 6. Thus, the flow amount of the working oil flowing from the discharge port 12 towards the suction port 11 is suppressed. Therefore, it is possible to improve the volumetric efficiency while preventing the enclosure of the pump chamber 6 of the vane pump 100.

Embodiments of this invention were described above, but the above embodiments are merely examples of applications of this invention, and the technical scope of this invention is not limited to the specific constitutions of the above embodiments.

This application claims priority based on Japanese Patent Application No. 2020-92179 filed with the Japan Patent Office on May 27, 2020, the entire contents of which are incorporated into this specification.

The invention claimed is:

1. A vane pump comprising:

a rotor linked to a driving shaft;

a plurality of vanes mounted to the rotor so as to freely and radially reciprocate with respect to a rotation axis of the rotor as the rotor rotates;

a cam ring having an inner circumferential surface on which tip ends of the vanes slide as the rotor is rotated, a space between the cam ring and the rotor being divided by the plurality of vanes to form a plurality of pump chambers; and a side member having:

a suction port configured to guide a working fluid to the pump chambers;

a discharge port configured to guide the working fluid discharged from the pump chambers; and a notch extending from an opening edge of the suction port in a reverse-rotation direction opposite to a rotation direction of the rotor, wherein an outer peripheral surface of the rotor has a plurality of protrusions and a plurality of recesses that alternate with one another, each protrusion protruding radially outward with respect to the rotation axis of the rotor, at a plane perpendicular to a rotation axis of the rotor, the cam ring has with respect to positions of the suction and discharge ports, a suction region and a discharge region, and a transition region from the discharge region to the suction region in the rotation direction so that each pump chamber successively passes through the discharge region, the transition region and the suction region as the rotor rotates, a volume of each pump chamber increases while a center of said each pump chamber passes through the suction region and decreases while the center of said each pump chamber passes through the discharge region, and each pump chamber is configured so that while the center of said each pump chamber passes through the transition region, said each pump chamber directly communicates with the discharge port and communicates with the suction port only through the notch.

2. The vane pump according to claim 1, wherein the cam ring has a first center angle formed by the pair of the vanes, a second center angle formed by a first line in a radial direction of the cam ring that passes through the opening edge of the suction port and a second line in the radial direction that passes through an opening edge of the discharge port, and a third center angle formed by the second line and a third line in the radial direction that passes through a tip of the notch, and the first center angle is equal to or smaller than the second center angle, and the third center angle is smaller than the first center angle.

3. The vane pump according to claim 1, wherein the plurality of vanes are respectively provided at respective ones of the tip ends of the protrusions of the rotor, the inner circumference surface of the cam ring has an ellipse shape having a major axis and a minor axis, viewed from the rotation axis of the rotor, and a center of the transition region is provided at the minor axis so that in each pump chamber, a gap between the outer peripheral surface at a corresponding one of the plurality of protrusions of the rotor and the inner circumferential surface of the cam ring becomes minimum when the center of said each pump chamber overlaps the center of the transition region, and while the center of said each pump chamber is in the transition region, said each pump chamber directly communicates with the discharge port only through the gap.

4. A vane pump, comprising:

a rotor linked to a driving shaft;

a plurality of vanes mounted in the rotor so as to freely and radially reciprocate with respect to a rotation axis of the rotor while the rotor rotates;

a cam ring having an inner circumferential surface on which tip ends of the vanes slide as the rotor is rotated, a space between the cam ring and the rotor being divided by the plurality of vanes to form a plurality of pump chambers;

a side member having:

a suction port configured to guide a working fluid to the pump chambers;

a discharge port configured to guide the working fluid discharged from the pump chambers; and a notch extending from an opening edge of the suction port in a reverse-rotation direction opposite to a rotation direction of the rotor, wherein at a plane perpendicular to a rotation axis of the rotor, the cam ring has with respect to positions of the suction and discharge ports, a suction region and a discharge region, and a transition region from the discharge region to the suction region in the rotation direction so that each pump chamber successively passes through the discharge region, the transition region and the suction region as the rotor rotates, a volume of each pump chamber increases while a center of said each pump chamber passes through the suction region and decreases while the center of said each pump chamber passes through the discharge region, each pump chamber is configured so that while the center of said each pump chamber passes through the transition region, said each pump chamber directly communicates with the discharge port and communicates with the suction port only through the notch, and a center angle of the cam ring formed by the pair of the vanes is greater than a center angle of the cam ring formed by a line in a radial direction of the cam ring that passes through a tip of the notch and a line in the radial direction that passes through at an opening edge of the discharge port.

* * * * *